US006427362B2

(12) United States Patent
Rork et al.

(10) Patent No.: US 6,427,362 B2
(45) **Date of Patent: *Aug. 6, 2002**

(54) BOOT WITH STRAPPING TO RESTRAIN MOVEMENT OF FOOT

(75) Inventors: Thomas F. Rork, Davenport, IA (US); Henry Groothaert, Moline, IL (US); Narong Hongpananonde, Davenport, IA (US)

(73) Assignee: Norcross Safety Products, L.L.C., Rock Island, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/759,691

(22) Filed: Jan. 12, 2001

Related U.S. Application Data

(63) Continuation of application No. 09/523,634, filed on Mar. 13, 2000, now Pat. No. 6,237,254.

(51) Int. Cl.[7] ..... A43B 1/10; A43B 23/28; A43B 7/22; A43B 5/04

(52) U.S. Cl. ..... 36/88; 36/91; 36/7.3; 36/58.5; 36/117.6; 36/117.9

(58) Field of Search ..... 36/88, 89, 91, 36/92, 7.1 R, 7.3, 51, 55, 58.5, 58.6, 117.6, 117.7, 117.8, 117.9, 50.1

(56) References Cited

U.S. PATENT DOCUMENTS

| | | | | |
|---|---|---|---|---|
| 2,591,211 A | | 4/1952 | Spencer | |
| 4,513,520 A | | 4/1985 | Koch | |
| 5,269,078 A | | 12/1993 | Cochrane | |
| 5,566,475 A | | 10/1996 | Donnadieu | |
| 5,704,138 A | | 1/1998 | Donnadieu | |
| 5,819,439 A | * | 10/1998 | Sanchez | 36/50.1 |
| 5,829,169 A | * | 11/1998 | James | 36/50.1 |
| 5,937,543 A | | 8/1999 | Hall et al. | |
| 5,940,990 A | | 8/1999 | Barret | |
| 5,946,827 A | * | 9/1999 | Okajima | 36/58.5 |
| 6,073,370 A | | 6/2000 | Okajima | |
| 6,237,254 B1 | * | 5/2001 | Rork et al. | 36/88 |
| 6,286,233 B1 | * | 9/2001 | Gaither | 36/50.1 |

FOREIGN PATENT DOCUMENTS

| | | |
|---|---|---|
| CA | 1255496 | 6/1989 |
| CH | 261350 | 8/1949 |

OTHER PUBLICATIONS

"Navy Team Designs Adjustable Firefighters Boot", *SSCOM Warrior*, Jan. 1997, pp. 14–15.

* cited by examiner

*Primary Examiner*—Anthony D. Stashick
(74) *Attorney, Agent, or Firm*—Wood, Phillips, Katz, Clark & Mortimer

(57) ABSTRACT

A boot comprises an upper, an outsole affixed to the upper, and an insole affixed within the boot. The upper includes a vamp, a counter, and a shaft. A flexible but substantially inelastic liner is affixed to the insole and to the upper, to and around an upper portion of the shaft, but is not affixed to the vamp, to the counter, or to a lower portion of the shaft. An ankle strap and an instep strap are affixed within the boot. The instep strap is affixed below the ankle strap. Being elastic, the ankle and instep straps are adapted to restrain a foot of a wearer so as to limit movement of the foot away from the counter, further into the vamp.

2 Claims, 3 Drawing Sheets

FIG. 3
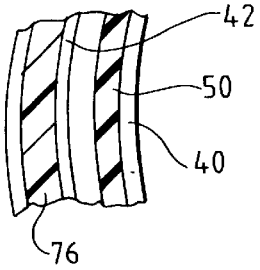
FIG. 4
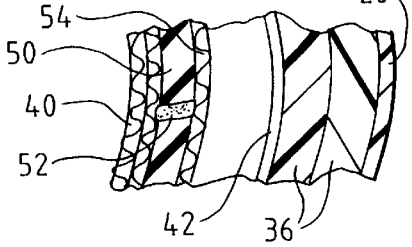
FIG. 2
FIG. 5
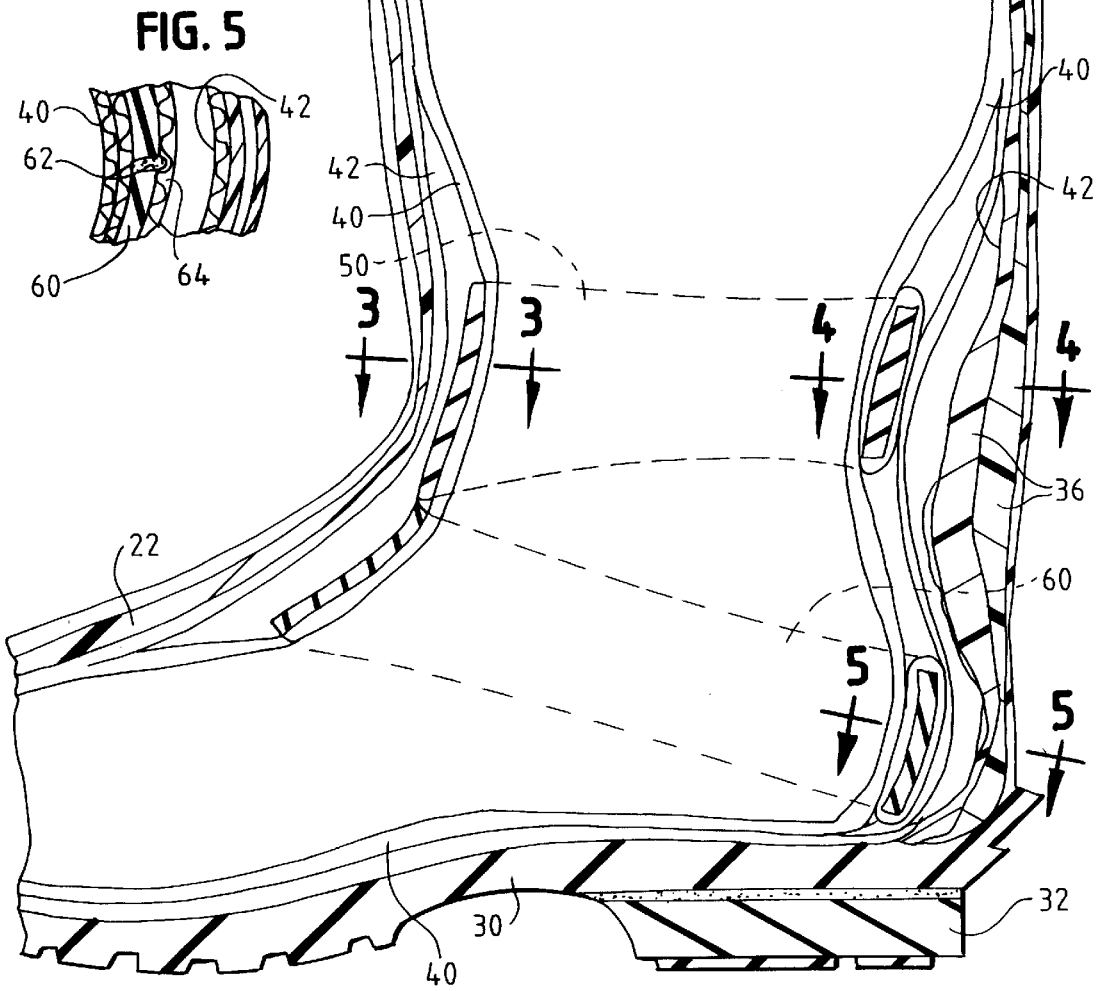

BOOT WITH STRAPPING TO RESTRAIN MOVEMENT OF FOOT

CROSS-REFERENCE TO RELATED APPLICATION

This application is a continuation of U.S. patent application Ser. No. 09/523,634, which was filed on Mar. 13, 2000 now U.S. Pat. No. 6,237,254.

STATEMENT REGARDING FEDERALLY SPONSORED RESEARCH OR DEVELOPMENT

Not applicable.

BACKGROUND OF THE INVENTION

1. Field of the Invention

This invention pertains to an improved boot, such as a firefighter's boot, which has a novel arrangement of strapping to restrain movement of a wearer's foot within the boot. The improved boot allows one size of the boot to be comfortably worn by a wearer whose foot is sized to any one of a range of sizes and also causes a boot of the size of the wearer's foot to be more comfortable.

2. Description of the Related Art

As exemplified in U.S. Pat. No. 5,937,543, which is assigned to the United States of America as represented by the Secretary of the Navy, prior efforts have been made to develop a boot so that one size of the boot can be comfortably worn by a wearer whose foot is sized to any one of a range of sizes. U.S. Pat. No. 5,937,543 discloses an inner sock of elastic material, such as closed cell neoprene foam, which sock is fixed to an insole of a boot and to a calf area of the boot.

Although it is believed that the boot disclosed in U.S. Pat. No. 5,937,543 can be comfortably worn by a wearer whose foot is sized to any one of a range of sizes, it is believed that such a boot cannot be easily manufactured with a predominantly rubber upper and with a predominantly rubber sole, by conventional vulcanizing methods, as closed cell neoprene foam takes a set and loses its elasticity when vulcanized, whereupon it is believed necessary to glue the inner sock into the boot after the boot has been vulcanized without the inner sock. Moreover, it is believed that such a boot is prone to failing where the inner sock is glued into the boot, particularly when the boot is removed while the liner is wet.

This invention has resulted from further efforts to develop a boot, not only so that one size of the boot can be comfortably worn by a wearer whose foot is sized to any one of a range of sizes but also so that the boot can be easily manufactured with a predominantly rubber upper and with a predominantly rubber sole, by conventional vulcanizing methods.

SUMMARY OF THE INVENTION

This invention provides a boot, which is similar to prior boots in that the boot comprises an upper, an outsole affixed to the upper, and an insole affixed within the boot, which may have one or more midsoles between the sole and the insole. As in prior boots, the upper includes a vamp, a heel, and a shaft. As improved by this invention, the boot comprises at least one strap affixed within the boot and adapted to restrain a foot of a wearer so as to limit movement of the foot away from the heel, further into the vamp. Preferably, the boot comprises two such straps, an ankle strap and an instep strap below the ankle strap.

Preferably, the boot comprises an insole disposed within the boot and a liner disposed within the upper. If provided, the liner is affixed to the insole and is affixed to and around an upper portion of the shaft, above the at least one strap, but is not affixed to the vamp, to the counter, to the quarter, or to a lower portion of the shaft, at or below the at least one strap, which wraps the liner where the liner is not affixed.

In a preferred embodiment, in which the boot comprises the ankle and instep straps discussed above and the liner discussed above, the liner is affixed to the insole and to the upper, to and around an upper portion of the shaft, above the ankle strap but is not affixed to the vamp or to a lower portion of the shaft, at or below the ankle strap. Moreover, in the preferred embodiment, the ankle and instep straps wrap the liner where the liner is not affixed.

These and other objects, features, and advantages of this invention are explained in the following description of a preferred embodiment of this invention, with reference to the accompanying drawings.

BRIEF DESCRIPTION OF THE DRAWINGS

FIG. 2 is a fragmentary, sectional view taken along line 2—2 of FIG. 1, in a direction indicated by arrows.

FIG. 3 is a sectional view taken along line 3—3 of FIG. 2, in a direction indicated by arrows.

FIG. 4 is a sectional view taken along line 4—4 of FIG. 2, in a direction indicated by arrows.

FIG. 5 is a sectional view taken along line 5—5 of FIG. 2, in a direction indicated by arrows.

DETAILED DESCRIPTION OF THE PREFERRED EMBODIMENT

Figure 1:
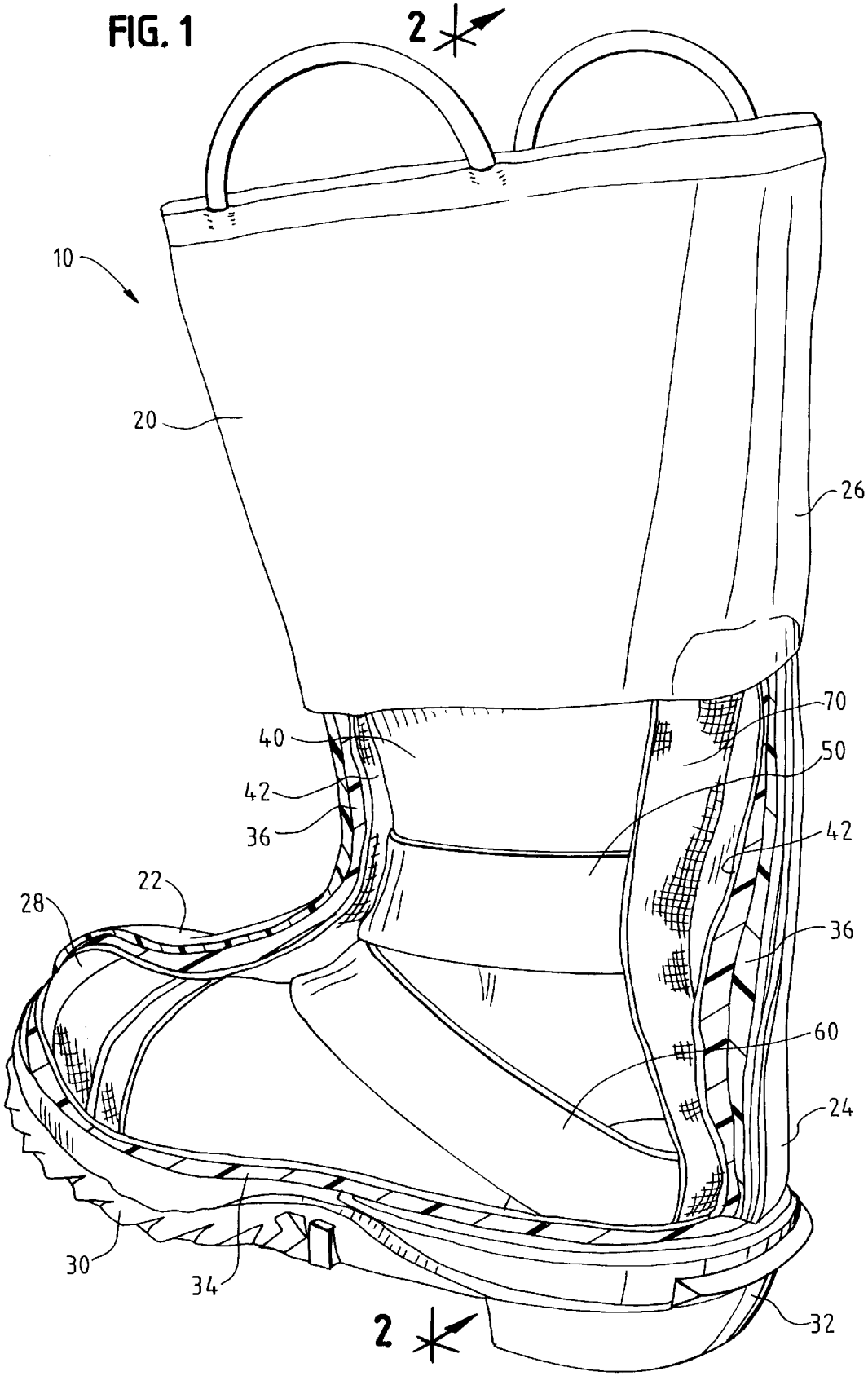
FIG. 1 is a partly broken away, perspective view of a boot constituting a preferred embodiment of this invention.

As shown in the drawings, a boot 10 constituting a preferred embodiment of this invention comprises a predominantly rubber upper 20, a predominantly rubber outsole 30 affixed to the upper, a predominantly rubber heel 32 affixed to the outsole 30, and an insole 34 affixed within the boot 10. The upper 20 includes a vamp 22, a counter 24, and a shaft 26, as well as a quarter (not shown) between the vamp 22 and the counter 24, below the shaft 26. The boot 10 may comprise other elements (not shown) used conventionally in vulcanized boots, such as a steel toe 28, one or more midsoles, one of which may include a steel plate, and one or more thermal liners 36 lining at least portions of the upper 20 and being bonded thereto when the boot 10 is vulcanized.

The boot 10 comprises a liner 40, which is made of a heat-resistant material, such as Nomex™, a cut-resistant material, such as Kevlar™, or a blend of such materials, such a blend being preferred. A wool felt or other material having suitable properties can be alternatively used for the liner 40. The liner 40 has a rubberized exterior enabling the liner 40 to bond to adjacent rubber or rubberized materials when the boot 10 is vulcanized. Non-rubberized fabric 42 is used to line selected areas of the upper 20 (or of a thermal liner 36 lining the upper 20) so that the liner 40 does not bond to those areas that are lined with such fabric 42 when the boot 10 is vulcanized. Thus, when the boot 10 is vulcanized, the liner 40 is affixed to the insole 34 and to and around an upper portion of the shaft 26, via the rubberized exterior of the liner 40, but is not affixed to the vamp 22, to the quarter, or to a lower portion of the shaft 26, where selected areas are lined by non-rubberized fabric 42.

The boot 10 comprises an ankle strap 50 and an instep strap 60, both being made from a silicone rubber, which does not bond to adjacent rubber or rubberized materials when the boot 10 is vulcanized. Herein, an ankle strap refers to a strap encircling the ankle portion of the wearer's foot and an instep strap refers to a strap encircling the instep and heel portions of the wearer's foot. A preferred material for these straps 50, 60, is a silicone rubber available commercially from Kirkhill Rubber Co. of Brea, Calif. These straps 50, 60, wrap the liner 40 where the liner 40 is not affixed. These straps 50, 60, restrain the wearer's foot so as to limit movement of the foot away from the counter 24, further into the vamp 22. Being elastic, these straps 50, 60, draw the wearer's foot into the counter 24.

As shown in FIG. 4, the opposite ends of the ankle strap 50 are joined to each other at a butt seam 52, by a suitable adhesive, such as PSA 529 adhesive, which is available commercially from General Electric Silicone Division of Waterford, N.Y. The butt seam 52 is wrapped with a short length 54 of rubberized fabric tape of a type used conventionally in the manufacture of predominantly rubber boots, which tape 54 is used initially to secure the butt seam 52 until the adhesive cures and subsequently to enable the ankle strap 50 to be later affixed to the liner 40, within the counter 24 of the upper 20, when the boot 10 is vulcanized. As shown in FIG. 5, the opposite ends of the instep strap 60 are joined to each other at a butt seam 62, by similar adhesive, and the butt seam 62 is wrapped with a short length 64 of similar tape. Both lengths 54, 64, of such tape are covered with a length 70 of non-rubberized fabric tape, which prevents such lengths 54, 64, from bonding to outer rubber or rubberized surfaces when the boot 10 is vulcanized.

Figure 6:
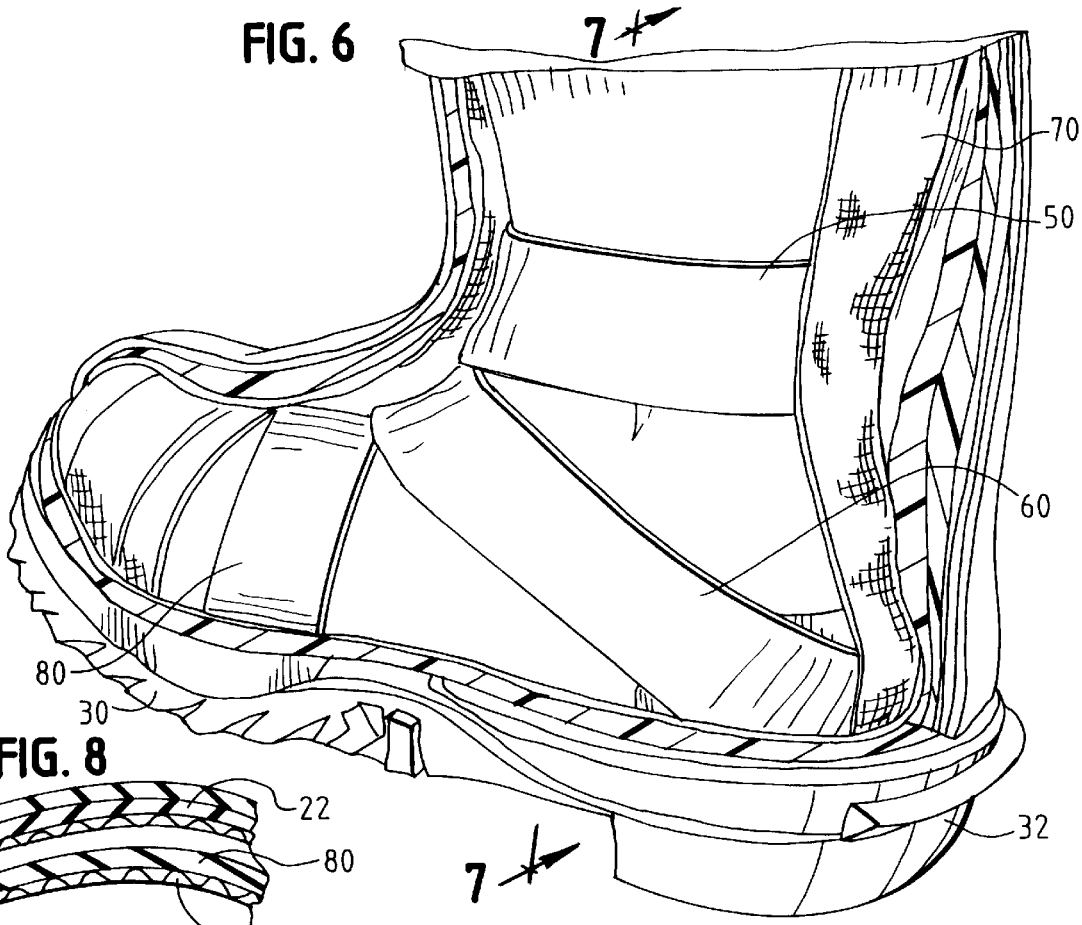
FIG. 6 is a further broken away, perspective view of a boot constituting a modified embodiment of this invention.
Figure 8:
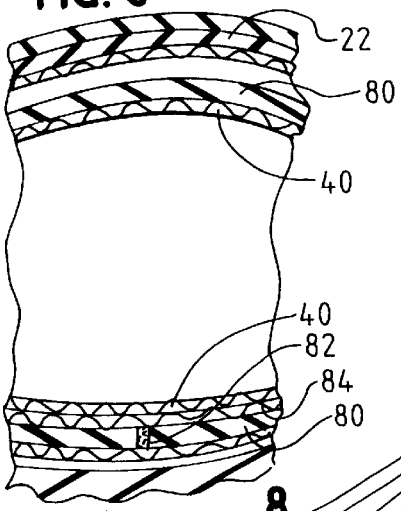
FIG. 8 is a sectional view taken along line 8—8 of FIG. 7, in a direction indicated by arrows.
Figure 7:
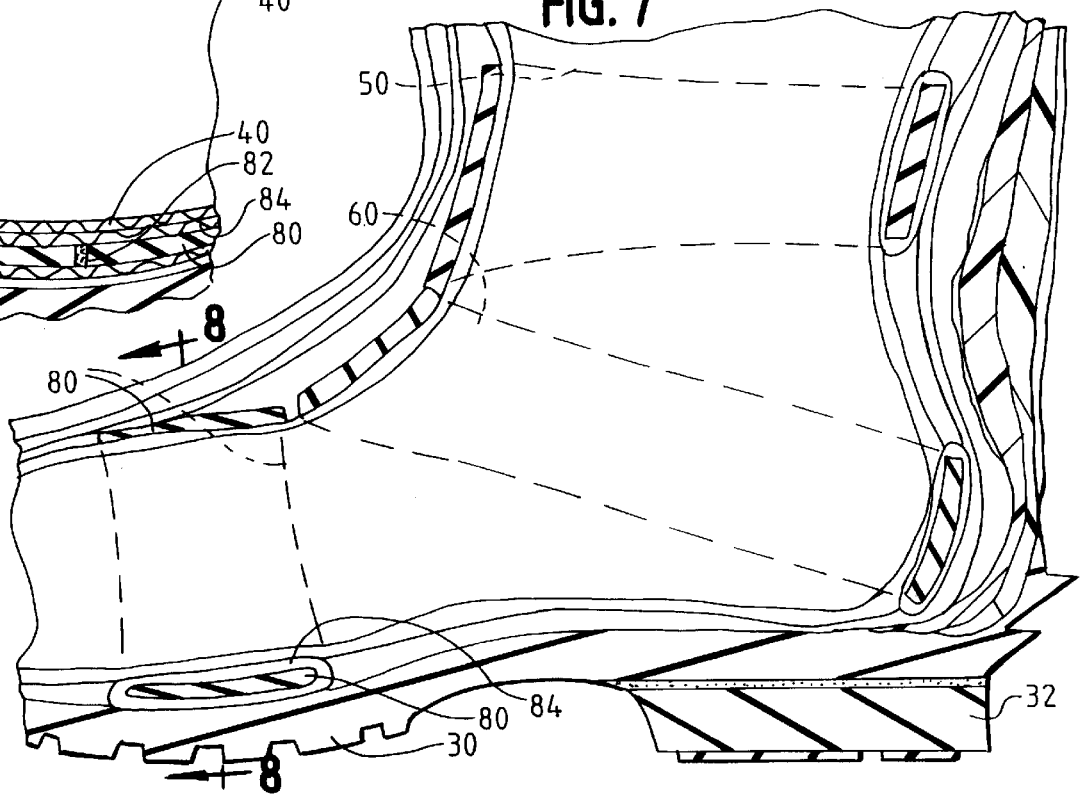
FIG. 7 is a fragmentary, sectional view taken along line 7—7 of FIG. 6, in a direction indicated by arrows.

As shown in FIGS. 6, 7, and 8, another has modified the boot 10 by providing another elastic strap 80, which is similar to the straps 50, 60, and which has a butt seam 82 that is similar to the butt seams 52, 62, and that is wrapped similarly with a short length 84 of rubberized fabric tape of the type used for the short lengths 54, 64. The tape length 84, which is disposed beneath the liner 40, within the vamp 22, bonds the strap 80 to the liner 40 and to the insole 34 when the boot 10 is vulcanized. The strap 80 is adapted, where disposed, to draw the ball of the wearer's foot downwardly against the insole 34.

Advantageously, one size of the boot 10 can be comfortably worn by a wearer whose foot is sized to any one of a range of sizes. Even if the size of the boot 10 is correct for the wearer's foot, the boot 10 tends to be more comfortable and to be more secure, particularly when worn under adverse conditions. Additionally, the boot 10 can be easily manufactured by conventional vulcanzing methods.

What is claimed is:

1. A boot comprising an upper, an outsole affixed to the upper, and at least two straps located and affixed within the boot, the upper including a vamp, a counter, and a shaft, the straps being adapted to restrain a foot of a wearer so as to limit movement of the foot away from the counter, further into the vamp, the straps including a separate ankle strap adapted to encircle an ankle portion of the foot and a separate instep strap adapted to encircle instep and heel portions of the foot.

2. The boot of claim 1 wherein the straps are elastic so as to draw the foot toward the counter.

* * * * *